United States Patent [19]

Cheklich et al.

[11] 4,156,560

[45] May 29, 1979

[54] ELECTRICALLY-CONTROLLED FUEL INJECTOR

[75] Inventors: George E. Cheklich, Bloomfield Hills, Mich.; Edward T. Vincent, Santa Barbara, Calif.

[73] Assignee: The United States of America as represented by the Secretary of the Army, Washington, D.C.

[21] Appl. No.: 849,834

[22] Filed: Nov. 9, 1977

[51] Int. Cl.[2] ..... F02M 51/06

[52] U.S. Cl. ..... 251/30; 123/32 JV; 123/139 E; 239/533.8

[58] Field of Search ..... 123/32 JV, 32 AE, 139 E, 123/139 AT; 251/30; 239/533.8

[56] References Cited

U.S. PATENT DOCUMENTS 2,420,550 5/1947 Miller ..... 239/533.8 X 3,777,977 12/1973 Regneault et al. ..... 239/533.8 X 3,921,604 11/1975 Links ..... 123/32 AE

FOREIGN PATENT DOCUMENTS 1805376 7/1970 Fed. Rep. of Germany ..... 123/32 AE

*Primary Examiner*—Gerald A. Michalsky

*Attorney, Agent, or Firm*—Peter A. Taucher; John E. McRae; Nathan Edelberg

[57] ABSTRACT

An electrically-controlled fuel injector comprising a balanced pressure spool valve that alternately connects an injector plunger control chamber to fuel supply pressure or drain pressure, thereby putting the injector plunger in the closed mode or the injection mode. Fuel pressure is utilized so that the spool valve can be operated (moved) by a relatively small size solenoid. This injector is particularly designed for use in electronic fuel injection systems.

1 Claim, 3 Drawing Figures

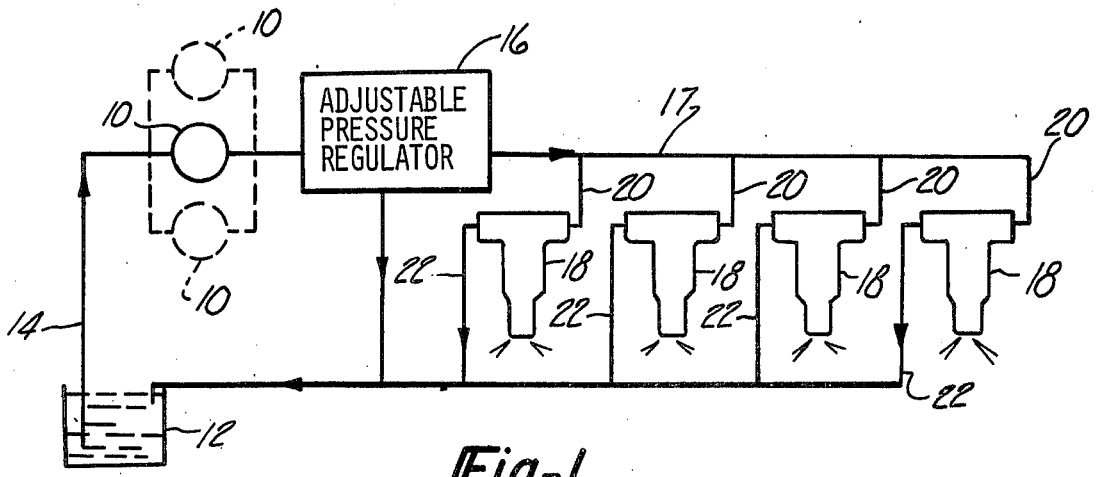
Fig-1
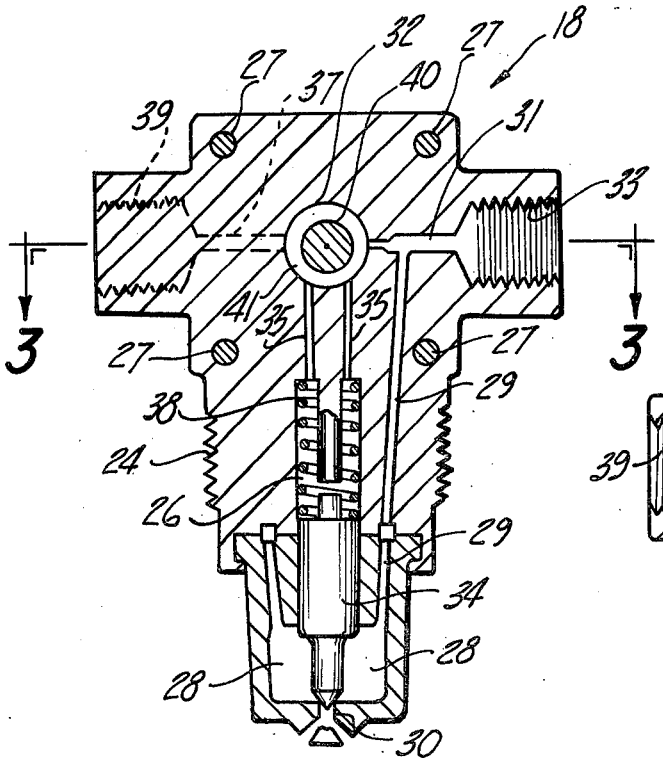
Fig-2
Fig-3
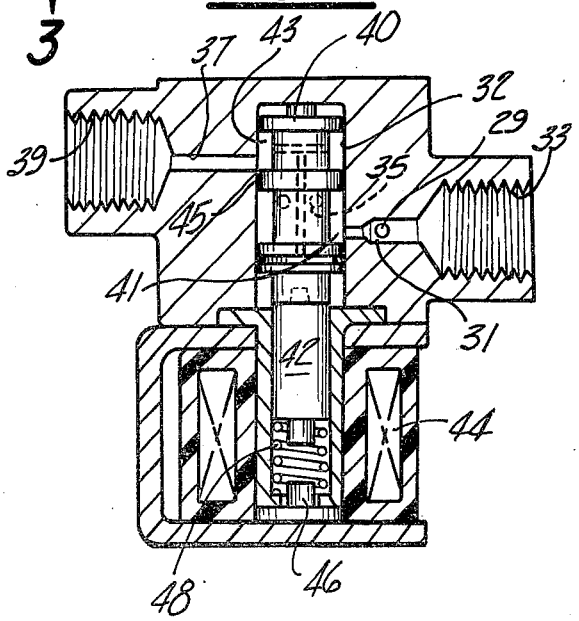

ELECTRICALLY-CONTROLLED FUEL INJECTOR

BACKGROUND AND SUMMARY OF THE INVENTION

U.S. Pat. No. 2,420,550 issued to R. Miller on May 13, 1947 shows a fuel injector wherein the injector plunger 57 has equal opposite end areas exposed to an injection chamber 46 and a control chamber 52. A valve spool 14 is mechanically oscillated by engine-driven cam 8 to alternately connect control chamber 52 to the pressurized fuel supply 2 or the drain 69.

The patentee varies the start of injection and quantity of injection by means of a rack 35 and pinion 32. Rack movement rotates valve spool 14 so that relatively wide or relatively narrow sections of the flow control grooves 19 and 27 register with the various ports in valve housing 3.

The system shown in the Miller patent is advantageous in that relatively high fuel supply pressures can be used without premature opening or delayed closing of the discharge orifice 44 (FIG. 1 of the patent). However the Miller patented system lacks the capability for independent adjustment of the injection start time and injection quantity. In the Miller system movement of rack 35 simultaneously varies the start of injection (by groove 27) and the end of injection (by groove 19). At full load setting of rack 35 the injection might begin at approximately twenty five degrees before top dead center and end at approximately five degrees after top dead center. At light load setting of rack 35 the injection might begin at approximately twelve degrees before top dead center and end at approximately two degrees before top dead center.

The present invention involves a redesign of the Miller system so that start of injection and quantity of injection can be independently varied or adjusted. The air is to improve fuel-air mixing and combustion over a wide range of operating conditions. The sought-for improvement is obtained by operating the spool valve with an electric solenoid rather than by mechanical cams or cranks. Present day electronics are at the stage where electrical transducers can be utilized to very accurately start and end the flow of current to each solenoid (at each injector). It thus now becomes practical to electronically vary the start of injection and/or end of injection independently, thereby providing improved engine operation over a range of conditions.

The present invention also aims at reducing the piping complexity and housing complexity evident in the Miller patent arrangement. In our improved version the control valve (solenoid-operated) is disposed within the same housing as the injector plunger, thereby enabling various passages to be formed internally as straight drilled holes rather than externally as extraneous tubes and tube fittings. The accommodation of the control valve and injector plunger within a single housing reduces fabrication cost, overall housing size, and maintenance difficulties (especially when it becomes necessary to troubleshoot, and/or remove injectors, and/or install new injectors).

The invention described herein may be manufactured, used, and licensed by or for the Government for governmental purposes without payment to us of any royalty thereon.

THE DRAWINGS

FIG. 1 schematically illustrates an engine fuel supply system utilizing injectors constructed according to the present invention.

FIG. 2 is a sectional view taken through one injector built according to this invention.

FIG. 3 is a sectional view taken on line 3—3 in FIG. 2.

The fuel supply system of FIG. 1 includes one (or preferably more than one) fuel pump 10 for drawing fuel (diesel oil, gasoline, alcohol, etc.) from a fuel tank 12 through line 14. After passage through a regulator 16 the fuel at relatively high pressure on the order of 15,000 p.s.i. is supplied to the individual injectors 18 (one for each cylinder in the engine) through individual branch lines 20. Excess fuel is discharged from each injector through a drain line 22. Fuel at high pressure (e.g. 15,000 p.s.i.) is injected into each cylinder of the engine via small orifices at the lower end of each injector. The system of FIG. 1 is a so-called constant pressure system in that the high side pressure in line 17 is relatively constant throughout the engine run period. Constant pressure may be achieved by regulator 16 and/or utilization of three pumps 10 one hundred twenty degrees out of phase (for minimizing pulsations on the high side of the system). Pressure regulator 16 may be adjustable to provide different pressure settings for different load conditions.

Referring to FIGS. 2 and 3, there is shown one of the injectors 18 comprising a two piece housing 24 that defines a plunger control chamber 26, an injection chamber 28 having a discharge orifice 30, and a valve chamber 32. An injector plunger 34 is slidably disposed within the housing so that one of its ends is exposed to chamber 26 and its other end is exposed to chamber 28. The exposed end areas of plunger 34 are equal (except for the small tip area circumscribed by orifice 30); therefore when the fuel pressures in chambers 26 and 28 are equalized (the same) then plunger 34 tends to assume a balanced floating condition. A relatively light compression spring 38 normally biases the injector plunger to a closed position preventing outflow of pressurized fuel from chamber 28 through orifice 30. When chamber 26 is depressurized (i.e. connected to the drain) then the pressure in chamber 28 quickly forces the plunger upwardly to permit outflow of pressurized fuel through orifice 30.

Pressurized fuel is initially admitted to chamber 28 through a drilled passage 29 that extends from drilled passage 31 leading from threaded counterbore 33. A pressure fitting (not shown) threads into counterbore 33 to mount the high pressure line 20 shown in FIG. 1.

Drilled passage 31 intersects the aforementioned valve chamber 32 that houses a spool valve plunger 40. In the valve position of FIG. 3 a groove 41 in the valve plunger forms a communication between passage 31 and one or more control passages 35 leading to chamber 26. Under such conditions chambers 26 and 28 are simultaneously pressurized through passages 35 and 29, respectively.

Spool type plunger 40 includes two axially spaced grooves 41 and 43 separated by a land 45. In the valve position shown in FIG. 3 groove 41 forms a communicating path between supply passage 31 and control passage 35. Groove 43 communicates with a drain passage 37 leading to a threaded counterbore 39. The counterbore receives the drain tube or line 22 shown in FIG. 1.

Axial movement of spool 40 causes land 45 to pass across passages 35, thereby enabling groove 43 to form a communicating path between control passages 35 and drain passage 37. This action depressurizes chamber 26 (FIG. 2) without affecting chamber 28; chamber 28 continues to be in a pressurized condition.

Movement of spool 40 is produced by electrical energization of solenoid winding 44. As the winding is energized armature 42 (connected to spool 40) is drawn toward pole piece 46 against the return force of coil spring 48. When the solenoid winding is de-energized spring 48 returns spool plunger 40 to its FIG. 3 position. The solenoid may be mounted on housing 24 by means of four screws 27 (FIG. 2) extending through the solenoid frame into tapped holes in the housing.

Solenoid winding 44 is electrically connected to an electrical control circuit (not shown) that delivers electrical current to the solenoid in timed relation to the engine cycle. The electrical control circuit can include various electrical transducers that regulate or adjust the timing and duration of the electric signal supplied to the solenoid in accordance with variations in different operating conditions, such as air flow rate, air temperature, fuel pressure, engine speed, and engine load. Suitable electrical control circuits are shown in U.S. Pat. No. 3,839,997 issued to F. P. Mennesson, U.S. Pat. No. 3,774,580 issued to J. P. McGavic, U.S. Pat. No. 3,587,535 issued to J. A. Kimberley, and U.S. Pat. No. 3,786,788 issued to T. Suda et al.

The spool-like nature of valve plunger 40 enables the plunger to be operated back and forth by a relatively small solenoid. Thus, each groove 41 or 43 includes groove sidewalls having equal areas exposed to the high side pressure or low side pressure; the pressures act equally in opposite directions so that forces are balanced. Operating force requirements are approximately proportional to the cross sectional areas of the ports defined by passages 35. In most cases such areas are relatively small.

The device shown in the drawings operates somewhat like the devices shown in U.S. Pat. No. 2,420,550 issued to R. Miller. However in our arrangement the spool valve is operated by a solenoid rather than by an engine-driven cam. By using an electrical solenoid operator it is possible to independently adjust the start of injection and the duration of injection in response to other parameters than engine speed. Thus, it is possible to operate the solenoid in accordance with such factors as air flow rate and engine load. When an engine-driven cam is used as the operator, as in the Miller patent, the length of the plunger stroke is predetermined by the nature of the cam operator.

Miller is able to adjust the effective (or useful) length of the plunger stroke by employing a rack-pinion mechanism 35,31, together with special configurations for grooves 19 and 27. Rotational adjustment of Miller's plunger 14 by rack 35 causes the grooves 19 and 27 to register with the high pressure ports or drain ports at different points along the plunger stroke. A disadvantage with the Miller method of adjustment is that a single mechanism (the rack) is used to adjust both the start of injection and the end of injection. In a typical situation at full load the start of injection might occur at about twenty five degrees before top dead center; end of injection might occur at about five degrees after top dead center. At partial load the start of injection might begin at about twelve degrees before top dead center and end at about two degrees before top dead center. The regulating actions for injection start and injection duration are undesirably intertwined so that it is not possible to independently regulate the timing and duration when using the mechanical type of adjustment contemplated in the Miller patent. Our use of a solenoid operator enables the injection timing and injection duration to be independently regulated for best engine operation over a wide range of operating conditions. This is especially important with high speed engines subjected to varying loads.

It will be noted that in our proposed system the axis of valve plunger 40 is oriented at right angles to the axis of injection plunger 34. This plunger disposition simplifies the passage arrangement in that the various passages 29, 35, 31 and 37 can be formed as straight drilled holes. The plunger orientation also reduces the total length of the injector housing, while locating the threaded openings 33 and 39 at approximately the same level for convenient connection with external lines 20 and 22. The injector housing configuration is believed to contribute to low manufacturing cost and relatively small space requirement in the engine compartment. Drilled passages 29, 31, 35 and 37 are located within the housing and are thus not as prone to leakage as would externally located lines.

We wish it to be understood that we do not desire to be limited to the exact details of construction shown and described for obvious modifications will occur to a person skilled in the art.

We claim:

1. A fuel injector for an internal combustion engine comprising a housing defining a plunger control chamber (26), an injection chamber (28) axially aligned with the control chamber, a discharge orifice (30) leading from the injection chamber, and a cylindrical valve chamber (32) oriented at right angles to the control chamber and injection chamber; an injector plunger (34) slidably disposed in the housing so that equal opposite end areas thereof are exposed to the injection chamber and control chamber; first spring means (38) biasing the injector plunger to a condition closing the discharge orifice when the control chamber pressure and injection chamber pressure are equalized; a non-rotary spool valve plunger (40) slidably disposed in the valve chamber for reciprocatory movement therein, said valve plunger having first and second grooves (41 and 43) separated by a land (45); solenoid means for moving the valve plunger in one direction; second spring means (48) for moving the valve plunger in the other direction; an internal fuel supply passage system comprising an internally threaded opening 33 in a side surface of the housing for mounting an external pressure line, a first passage (31) extending from the threaded opening into direct communication with the valve chamber at a first specific point therealong, and a second passage (29) extending from the first passage to the injection chamber; an internal drain passage system comprising a second internally threaded opening (39) in another side surface of the housing for mounting an external drain line, and a third passage (37) extending from the second internally threaded opening into direct communication with the valve chamber at a second specific point therealong; and a control passage system comprising a fourth passage (35) extending from the control chamber into communication with the valve chamber at a third specific point therealong; the valve plunger being oriented so that in one valve plunger position the fourth passage (35) communicates with the first passage (31) via the first groove (41), and in the other valve plunger position the fourth passage communicates with the third passage (37) via the second groove (43); said first and third passages occupying a common plane with the valve chamber, said common plane lying at right angles to the axis of the control chamber and injection chamber.

* * * * *